US012006948B2

(12) United States Patent
Kitamura et al.

(10) Patent No.: US 12,006,948 B2
(45) Date of Patent: Jun. 11, 2024

(54) PUMP DEVICE AND COOLING DEVICE

(71) Applicant: Nidec Corporation, Kyoto (JP)

(72) Inventors: Yoshihisa Kitamura, Kyoto (JP); Toshihiko Tokeshi, Kyoto (JP); Takehito Tamaoka, Kyoto (JP); Takaya Okuno, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 0 days.

(21) Appl. No.: 17/589,921

(22) Filed: Feb. 1, 2022

(65) Prior Publication Data

US 2022/0243735 A1 Aug. 4, 2022

Related U.S. Application Data

(60) Provisional application No. 63/145,415, filed on Feb. 3, 2021.

(30) Foreign Application Priority Data

Jun. 1, 2021 (JP) ..... 2021-092478

(51) Int. Cl.

| | |
|---|---|
| ***F04D 29/42*** | (2006.01) |
| ***F04D 1/06*** | (2006.01) |
| ***F04D 13/06*** | (2006.01) |
| ***F04D 13/14*** | (2006.01) |
| ***F04D 29/58*** | (2006.01) |

(52) U.S. Cl.

CPC ..... *F04D 29/426* (2013.01); *F04D 1/06* (2013.01); *F04D 13/06* (2013.01); *F04D 13/14* (2013.01); *F04D 29/4293* (2013.01); *F04D 29/586* (2013.01)

(58) Field of Classification Search

CPC ..... F04D 13/14; F04D 29/40; F04D 29/406; F04D 29/42; F04D 29/426; F04D 29/58; F04D 29/586; F04D 1/06; F04D 7/02; F04D 7/04; F04D 7/08; F04D 13/06; F04D 13/12; F04D 29/007; F04D 29/4293; H05K 7/20272

See application file for complete search history.

(56) References Cited

U.S. PATENT DOCUMENTS

| | | | | |
|---|---|---|---|---|
| 11,448,222 | B2 | 9/2022 | Tsai et al. | |
| 2016/0338223 | A1* | 11/2016 | Tsai | F28F 3/12 |
| 2017/0212560 | A1* | 7/2017 | Tsai | H05K 7/20272 |
| 2019/0187763 | A1* | 6/2019 | Chen | F04D 1/06 |
| 2019/0239388 | A1* | 8/2019 | Tsai | H05K 7/20263 |
| 2022/0039290 | A1* | 2/2022 | Tsai et al. | F04D 29/628 |
| 2022/0071058 | A1* | 3/2022 | Chen | F28F 9/18 |

* cited by examiner

*Primary Examiner* — Devon C Kramer
*Assistant Examiner* — Chirag Jariwala
(74) *Attorney, Agent, or Firm* — Keating & Bennett, LLP

(57) ABSTRACT

A pump device includes a first pump, a second pump, and a casing. The first pump and the second pump are centrifugal pumps. The casing includes a first pump chamber in which the first pump is located and a second pump chamber in which the second pump is located. The first pump chamber includes a first bottom surface, a first side surface, a first inlet, and a first outlet. The first bottom surface is located on one side in the first direction with respect to a first motor of the first pump. The first side surface is connected to the first bottom surface and extends in the first direction. The first outlet is open with respect to the first side surface. The second pump chamber includes a second bottom surface, a second side surface, a second inlet, and a second outlet.

10 Claims, 13 Drawing Sheets

PUMP DEVICE AND COOLING DEVICE

CROSS-REFERENCE TO RELATED APPLICATIONS

The present application is a Non-Provisional application of U.S. Provisional Patent Application No. 63/145,415, on Feb. 3, 2021, and claims priority under 35 U.S.C. § 119 to Japanese Patent Application No. 2021-092478, filed on Jun. 1, 2021, the entire contents of which are hereby incorporated herein by reference.

1. FIELD OF THE INVENTION

The present disclosure relates to a pump device and a cooling device.

2. BACKGROUND

A pump device including a first pump, a second pump, and a casing in which the first pump and the second pump are disposed is conventionally known. A liquid cooling heat dissipation structure including two pumps and an external cover on which the two pumps are disposed is conventionally known.

In the conventional liquid cooling heat dissipation structure, two pumps are connected in parallel. A movable member is disposed between the two pumps. The movable member prevents a coolant pushed out from one pump from flowing into the other pump when only one pump is driven. That is, the movable member functions as a check valve.

However, in the conventional liquid cooling heat dissipation structure, a movable member functioning as a check valve is required, and thus there is a problem that the number of components increases.

SUMMARY

An example embodiment of a pump device of the present disclosure is able to generate a flow of liquid. The pump device includes a first pump, a second pump, and a casing. The first pump and the second pump are in the casing. The first pump and the second pump are centrifugal pumps. The first pump includes a first motor. The second pump includes a second motor. The casing includes a first pump chamber in which the first pump is located and a second pump chamber in which the second pump is located. The first pump chamber includes a first bottom surface, a first side surface, a first inlet, and a first outlet. The first bottom surface is located on one side in a first direction with respect to the first motor. The first side surface is connected to the first bottom surface and extends in the first direction. The first inlet is open to the first bottom surface. The first outlet is open to the first side surface. The second pump chamber includes a second bottom surface, a second side surface, a second inlet, and a second outlet. The second bottom surface is located on one side in the first direction with respect to the second motor. The second side surface is connected to the second bottom surface and extends in the first direction. The second inlet is open to the second bottom surface. The second outlet is open to the second side surface. The casing includes a first flow path connecting the first outlet and the second inlet. The second bottom surface is located on another side in the first direction relative to the first bottom surface.

An example embodiment of a cooling device of the present disclosure is a cooling device that includes the pump device described above, a cold plate, and a heat exchange chamber. The casing further includes a second flow path. A partition includes a first partition and a second partition. The first partition and the casing main body define the first flow path. The second partition and the casing main body define the second flow path. The second partition and the cold plate define the heat exchange chamber. The second partition includes a heat exchange chamber connection port connecting the second flow path and the heat exchange chamber. The first flow path and the heat exchange chamber connection port overlap each other when viewed from the first direction.

Another example embodiment of a cooling device of the present disclosure includes the pump device described above, a cold plate, and a heat exchange chamber. The casing further includes a second flow path. The partition and the casing main body define the first flow path and the second flow path. The partition includes a heat exchange chamber connection port connecting the second flow path and the heat exchange chamber. The first flow path and the heat exchange chamber connection port are separated from each other when viewed from the first direction. The partition partitions the first flow path and the heat exchange chamber.

The above and other elements, features, steps, characteristics and advantages of the present disclosure will become more apparent from the following detailed description of the example embodiments with reference to the attached drawings.

DETAILED DESCRIPTION

Figure 1:
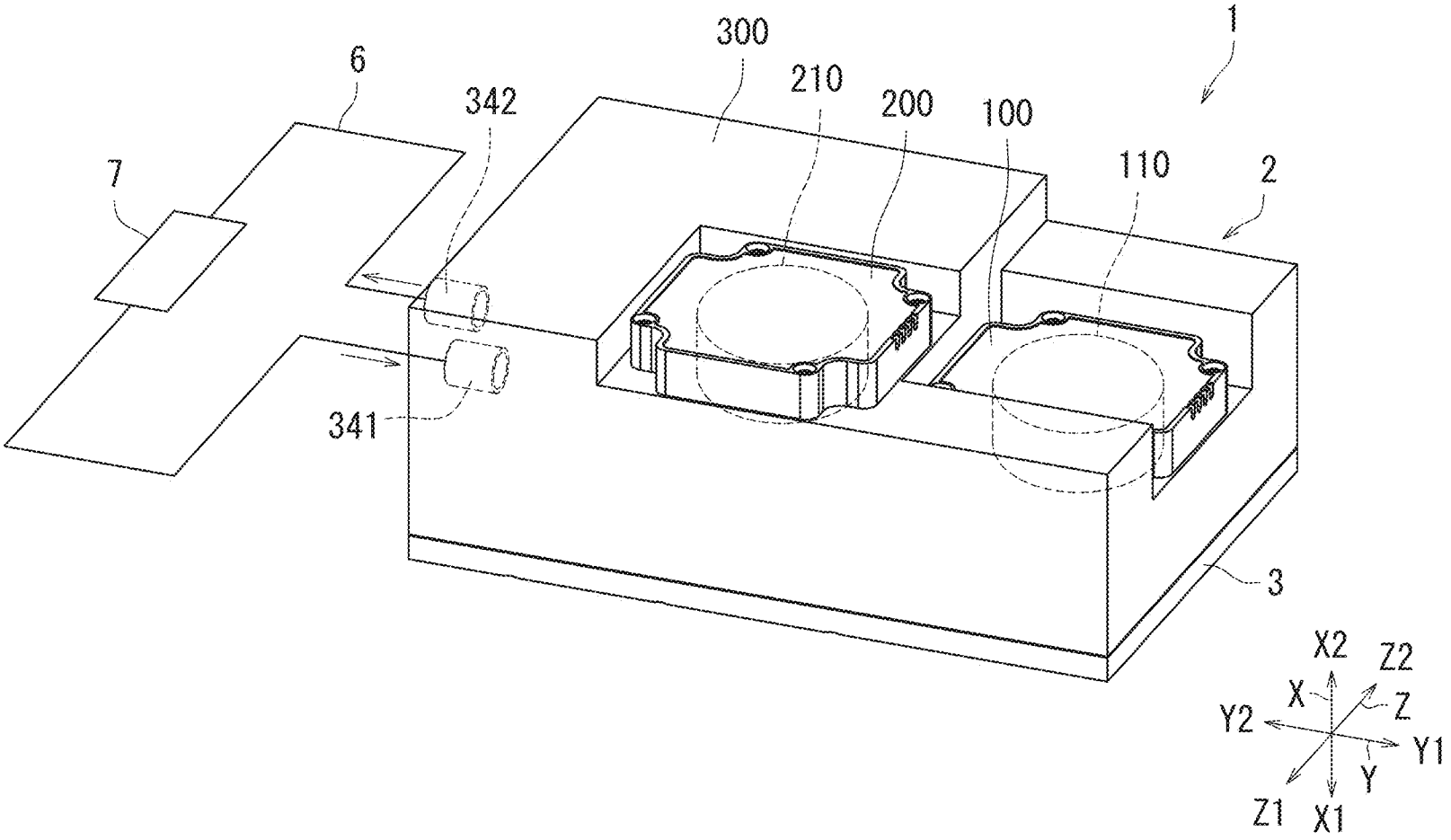
FIG. 1 is a perspective view showing a cooling device having a pump device according to a first example embodiment of the present disclosure and a circulation route connected to the cooling device.

Example embodiments of the present disclosure will be described below with reference to the drawings. In the drawings, the same or corresponding components are denoted by the same reference signs and description thereof will not be repeated.

In the present description, a first direction X, a second direction Y, and a third direction Z orthogonal to one another are appropriately described for easy understanding. One side in the first direction X is referred to as one side X1 in the first direction X, and the other side in the first direction X is referred to as the other side X2 in the first direction X. One side in the second direction Y is referred to as one side Y1 in the second direction Y, and the other side in the second direction Y is referred to as the other side Y2 in the second direction Y. One side in the third direction Z is referred to as one side Z1 in the third direction Z, and the other side in the third direction Z is referred to as the other side Z2 in the third direction Z. The first direction X is sometimes described as an up-down direction for convenience. The one side X1 in the first direction X indicates a downward direction, and the other side X2 in the first direction X indicates an upward direction. However, the up-down direction, the upward direction, and the downward direction are defined for convenience of description, and do not need to coincide with a vertical direction. The up-down direction is merely defined for convenience of description, and the orientation of a heat dissipation unit according to the present disclosure in use is not limited.

Figure 2:
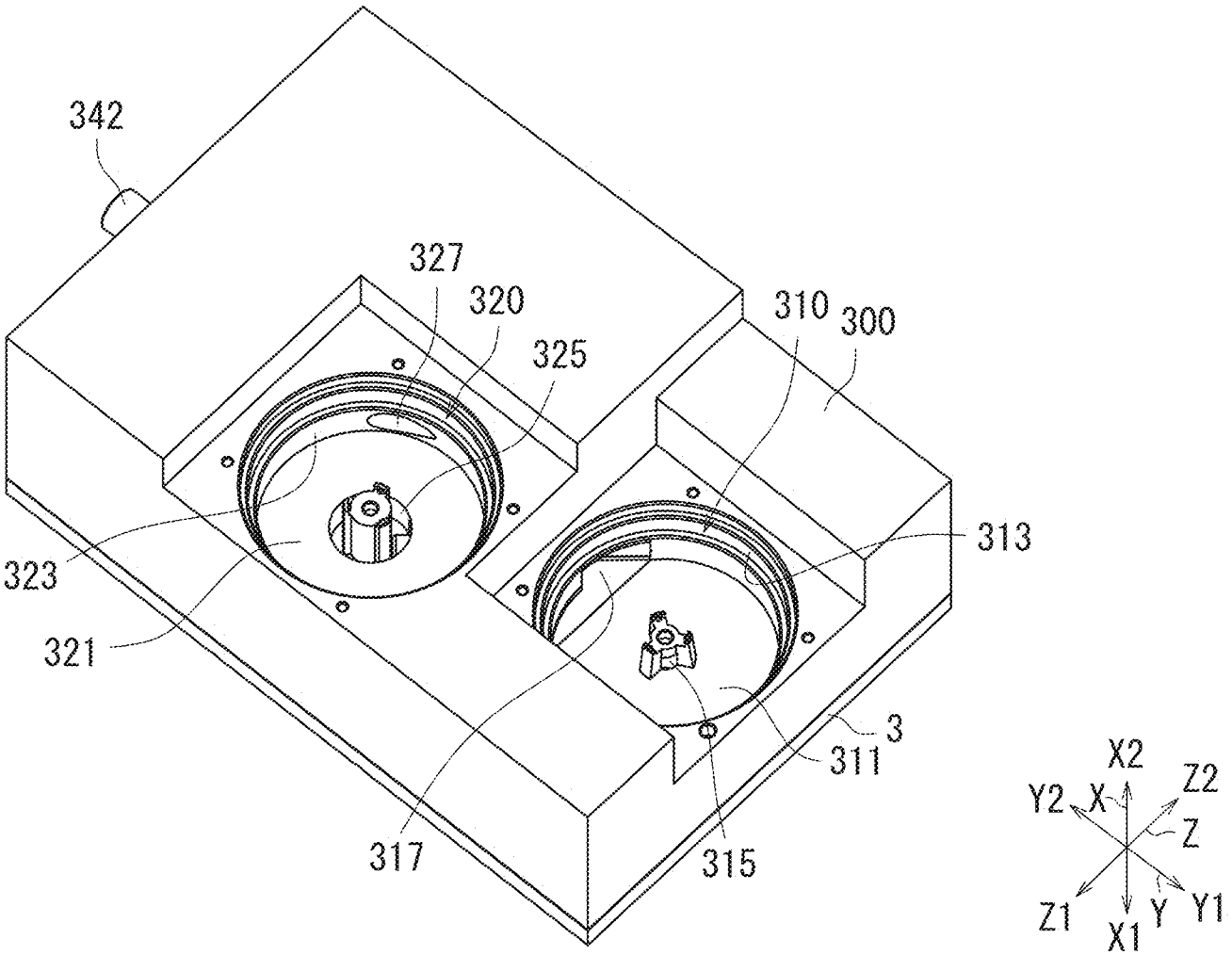
FIG. 2 is a perspective view showing a structure in which a first motor, a second motor, and the like are removed from the pump device of the first example embodiment.
Figure 3:
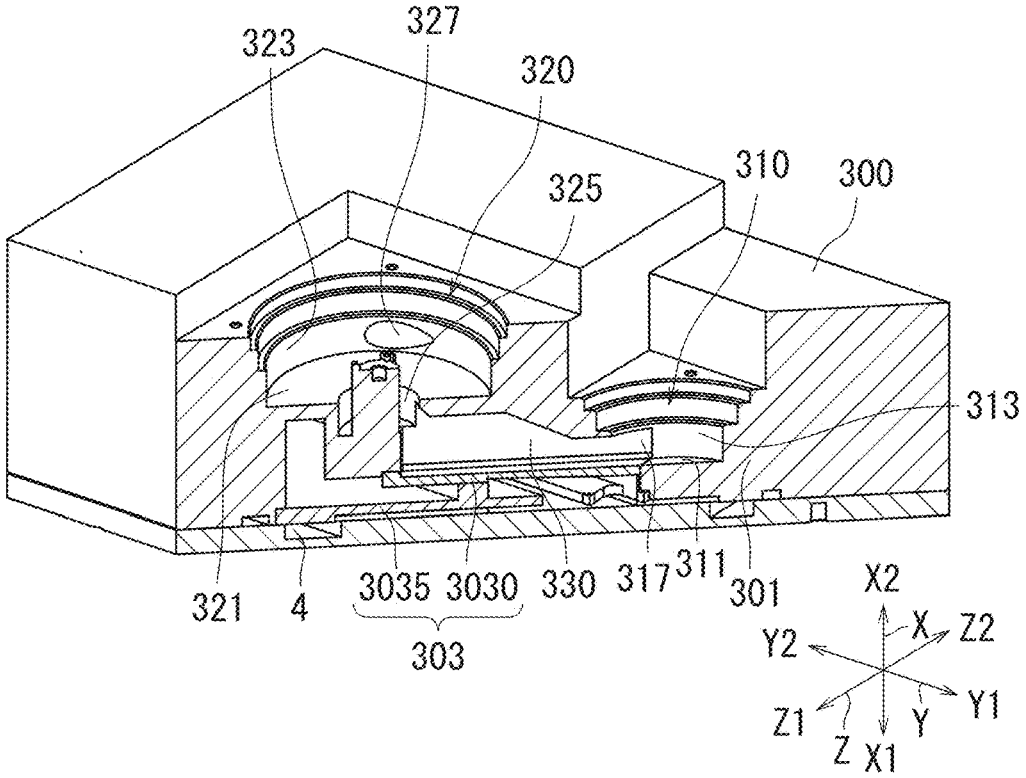
FIG. 3 is a cross-sectional perspective view showing a structure in which the first motor, the second motor, and the like are removed from the pump device of the first example embodiment.

A cooling device 1 including a pump device 2 according to the first example embodiment of the present disclosure will be described with reference to FIGS. 1 to 8. FIG. 1 is a perspective view showing the cooling device 1 including the pump device 2 according to the first example embodiment of the present disclosure and a circulation route 6 connected to the cooling device 1. FIG. 2 is a perspective view showing the structure in which a first motor 110, a second motor 210, and the like are removed from the pump device 2 of the first example embodiment. FIG. 3 is a cross-sectional perspective view showing the structure in which the first motor 110, the second motor 210, and the like are removed from the pump device 2 of the first example embodiment. In the present example embodiment, an example in which the pump device 2 is mounted on the cooling device 1 will be described.

As shown in FIG. 1, in the present example embodiment, the cooling device 1 has the pump device 2, a cold plate 3, and a heat exchange chamber 4 (see FIG. 3). The pump device 2 flows liquid. In the present example embodiment, the liquid functions as a coolant. The cold plate 3 is made of a metal having high thermal conductivity, such as copper or aluminum. The cold plate 3 comes into contact with a heat generating component (not illustrated). In the present example embodiment, the lower surface of the cold plate 3 comes into contact with the heat generating component. The heat generating component is not particularly limited, but may be, for example, a semiconductor device. The cold plate 3 absorbs heat from the heat generating component. This prevents the heat generating component from being heated to a high temperature. The cold plate 3 transfers heat absorbed from the heat generating component to the liquid (coolant) passing through the inside of the heat exchange chamber 4.

The cooling device 1 is connected to the circulation route 6 through which the liquid flows. The circulation route 6 includes, for example, a hose or a pipe. The circulation route 6 is provided with a heat exchange device 7. The heat exchange device 7 exchanges heat of the liquid flowing through the circulation route 6 with another medium. The heat exchange device 7 includes, for example, a heat dissipation device such as a radiator. Alternatively, the heat exchange device 7 may be, for example, a device that exchanges heat with respect to a flow passage through which another coolant flows. When the pump device 2 is driven, the liquid having heated to a high temperature in the heat exchange chamber 4 flows from the pump device 2 to the circulation route 6 and is cooled by the heat exchange device 7. The liquid whose temperature has decreased in heat exchange device 7 passes through circulation route 6 and flows into the heat exchange chamber 4 again, and absorbs the heat in the heat exchange chamber 4.

The pump device 2 has a first pump 100, a second pump 200, and a casing 300. The first pump 100 and the second pump 200 are disposed in the casing 300.

The first pump 100 and the second pump 200 are centrifugal pumps. The first pump 100 has the first motor 110. The second pump 200 has the second motor 210.

As shown in FIG. 2, the casing 300 includes a first pump chamber 310 and a second pump chamber 320. The first motor 110 is disposed in the first pump chamber 310. The first pump chamber 310 has a first bottom surface 311, a first side surface 313, a first inlet 315, and a first outlet 317.

The first bottom surface 311 is located on the one side X1 in the first direction X with respect to the first motor 110 (see FIG. 1). The first side surface 313 is connected to the first bottom surface 311 and extends in the first direction X. In the present example embodiment, the first side surface 313 is connected to the peripheral edge of the first bottom surface 311 and extends from the first bottom surface 311 toward the other side X2 in the first direction X. However, the first side surface 313 needs not to be exactly in the same direction with respect to the first direction X, and may extend in substantially the first direction X.

The first inlet 315 is open to the first bottom surface 311. The first inlet 315 is an opening through which liquid flows into from the outside to the inside of the first pump chamber 310. The first outlet 317 is open to the first side surface 313. The first outlet 317 is an opening through which liquid flows out from the inside to the outside of the first pump chamber 310.

In the second pump chamber 320, the second motor 210 (see FIG. 1) is disposed. The second pump chamber 320 has a second bottom surface 321, a second side surface 323, a second inlet 325, and a second outlet 327.

The second bottom surface 321 is located on the one side X1 in the first direction X with respect to the second motor 210. The second side surface 323 is connected to the second bottom surface 321 and extends in the first direction X. In the present example embodiment, the second side surface 323 is connected to the peripheral edge of the second bottom surface 321 and extends toward the other side X2 in the first direction X. However, the second side surface 323 needs not to be exactly in the same direction with respect to the first direction X, and may extend in substantially the first direction X.

The second inlet 325 is open to the second bottom surface 321. The second inlet 325 is an opening through which liquid flows into from the outside to the inside of the second pump chamber 320. The second outlet 327 is open to the second side surface 323. The second outlet 327 is an opening through which liquid flows out from the inside to the outside of the second pump chamber 320.

As shown in FIG. 3, the casing 300 has a first flow path 330. The first flow path 330 connects the first outlet 317 and the second inlet 325. That is, the first pump 100 and the second pump 200 are connected in series. The liquid flowing out of the first pump chamber 310 flows into the second pump chamber 320 via the first flow path 330.

Thus, in the present example embodiment, since the first pump 100 and the second pump 200 are connected in series, the liquid does not flow back even when one of the first pump 100 and the second pump 200 is stopped. Therefore, it is not necessary to provide a check valve, and it is hence possible to suppress the number of components from increasing.

In the present example embodiment, the second bottom surface 321 of the second pump chamber 320 is located on the other side X2 in the first direction X relative to the first bottom surface 311 of the first pump chamber 310. Therefore, it is possible to suppress the structure of the first flow path 330 connecting the first pump chamber 310 and the second pump chamber 320 from becoming complicated. The bottom surface of the first flow path 330 is a flat surface extending in the second direction Y and the third direction Z.

Note that, for example, unlike the present example embodiment, when the first bottom surface 311 and the second bottom surface 321 are disposed at the same position in a second direction Y, it is necessary to detour a downstream part of the first flow path 330 to the one side X1 (lower side) in the first direction X relative to the second bottom surface 321, and hence the structure of the first flow path 330 becomes complicated. When the downstream part of the first flow path 330 is detoured to the one side X1 in the first direction X relative to the second bottom surface 321, the volume of the heat exchange chamber 4 decreases, and thus the heat exchange efficiency decreases.

Figure 4:
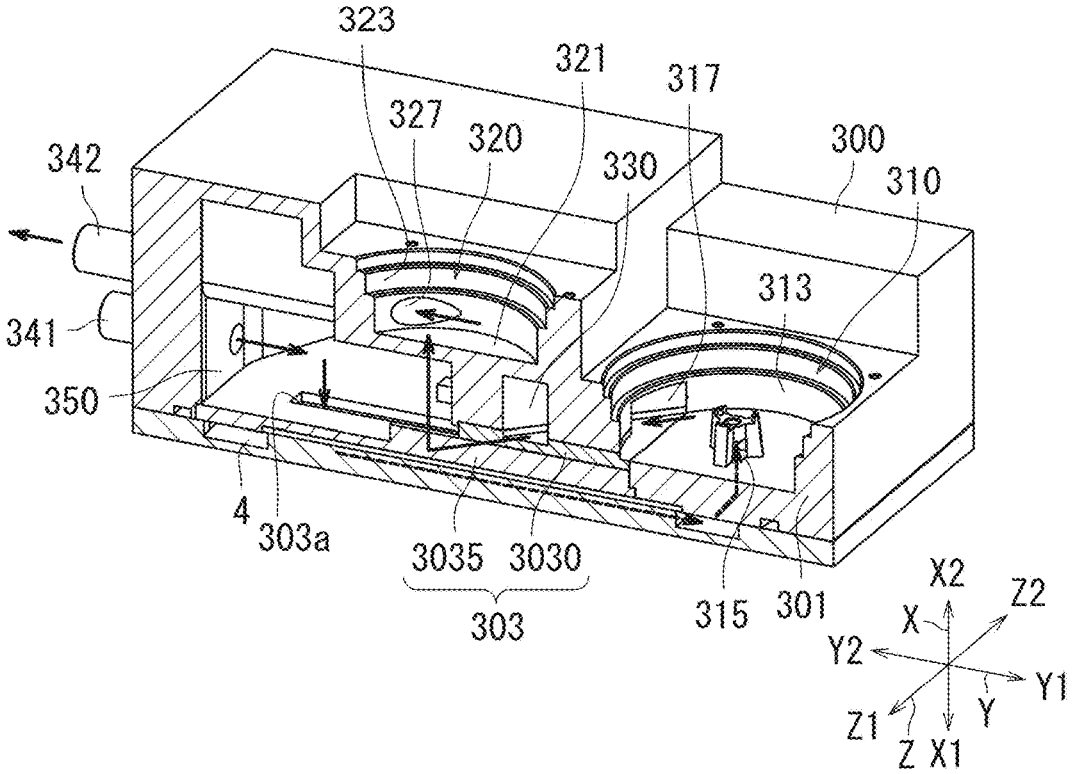
FIG. 4 is a cross-sectional perspective view showing a structure in which the first motor, the second motor, and the like are removed from the pump device of the first example embodiment.

Next, the structure around the pump device 2 will be described in detail. First, a route through which liquid flows in the pump device 2 will be briefly described with reference to FIGS. 1 and 4. FIG. 4 is a cross-sectional perspective view showing the structure in which the first motor 110, the second motor 210, and the like are removed from the pump device 2 of the first example embodiment.

As shown in FIG. 1, the casing 300 has a third inlet 341 and a third outlet 342. The third inlet 341 is an opening through which liquid flows into from the outside to the inside of the casing 300. The third inlet 341 is connected to the downstream end of the circulation route 6. The third outlet 342 is an opening through which liquid flows out from the inside to the outside of the casing 300.

As shown in FIG. 4, the casing 300 has a second flow path 350. The second flow path 350 is connected to the third inlet 341 (see FIG. 1). The second flow path 350 is disposed above the heat exchange chamber 4. The second flow path 350 is connected to the heat exchange chamber 4 via a heat exchange chamber connection port 303*a* described later.

The heat exchange chamber 4 is connected to the first pump chamber 310. As described above, the first pump chamber 310 is connected to the second pump chamber 320 via the first flow path 330. The second pump chamber 320 is connected to the third outlet 342.

In the present example embodiment, the liquid flowing into the pump device 2 from the circulation route 6 passes through the second flow path 350, the heat exchange chamber 4, the first pump chamber 310, the first flow path 330, and the second pump chamber 320, and returns to the circulation route 6. More specifically, the liquid passes through in order of the third inlet 341, the second flow path 350, the heat exchange chamber connection port 303*a* described later, the heat exchange chamber 4, the first inlet 315, the first pump chamber 310, the first outlet 317, the first flow path 330, the second inlet 325, the second pump chamber 320, the second outlet 327, and the third outlet 342.

Figure 5:
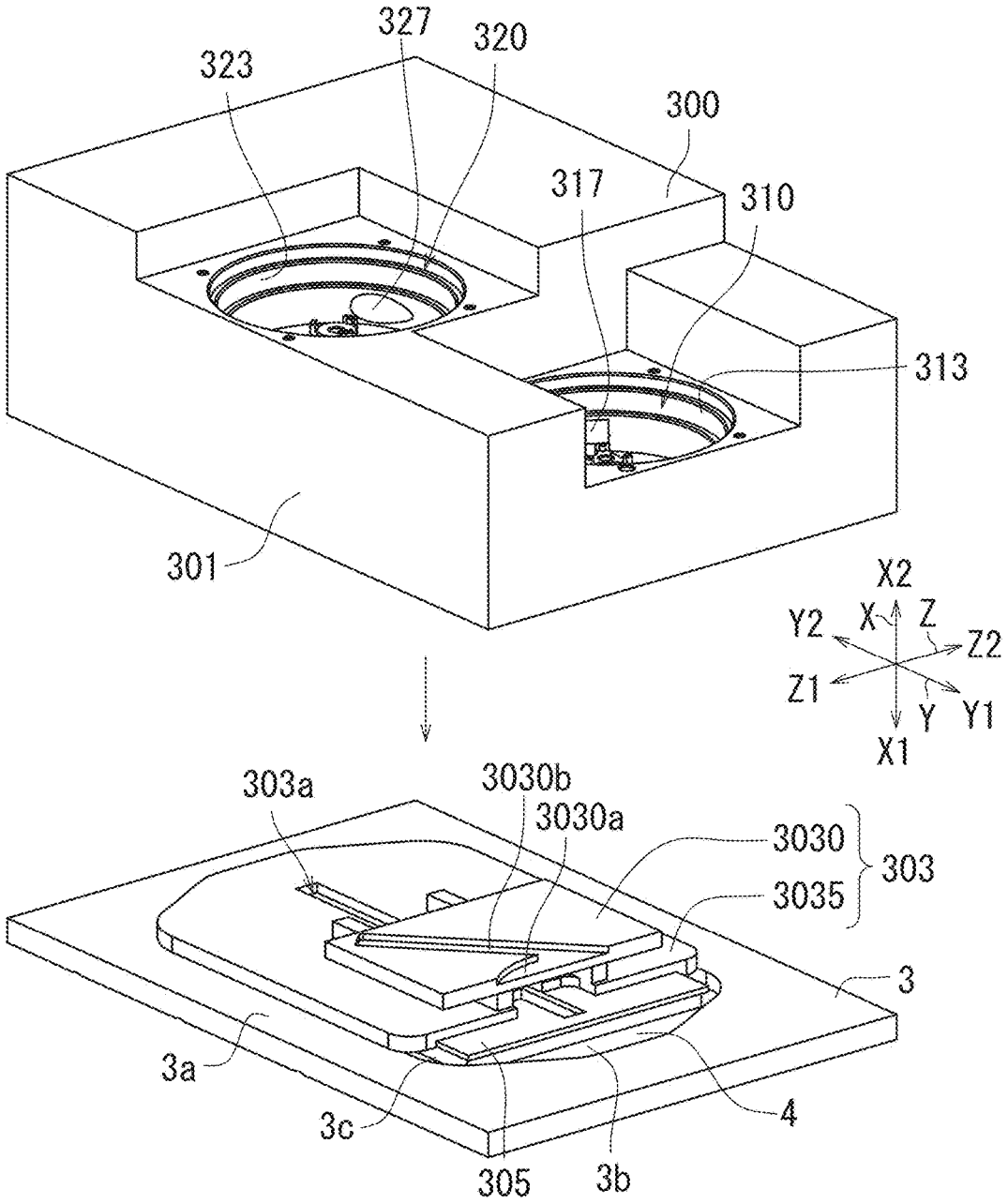
FIG. 5 is an exploded perspective view showing a structure in which the first motor, the second motor, and the like are removed from the pump device of the first example embodiment.
Figure 6:
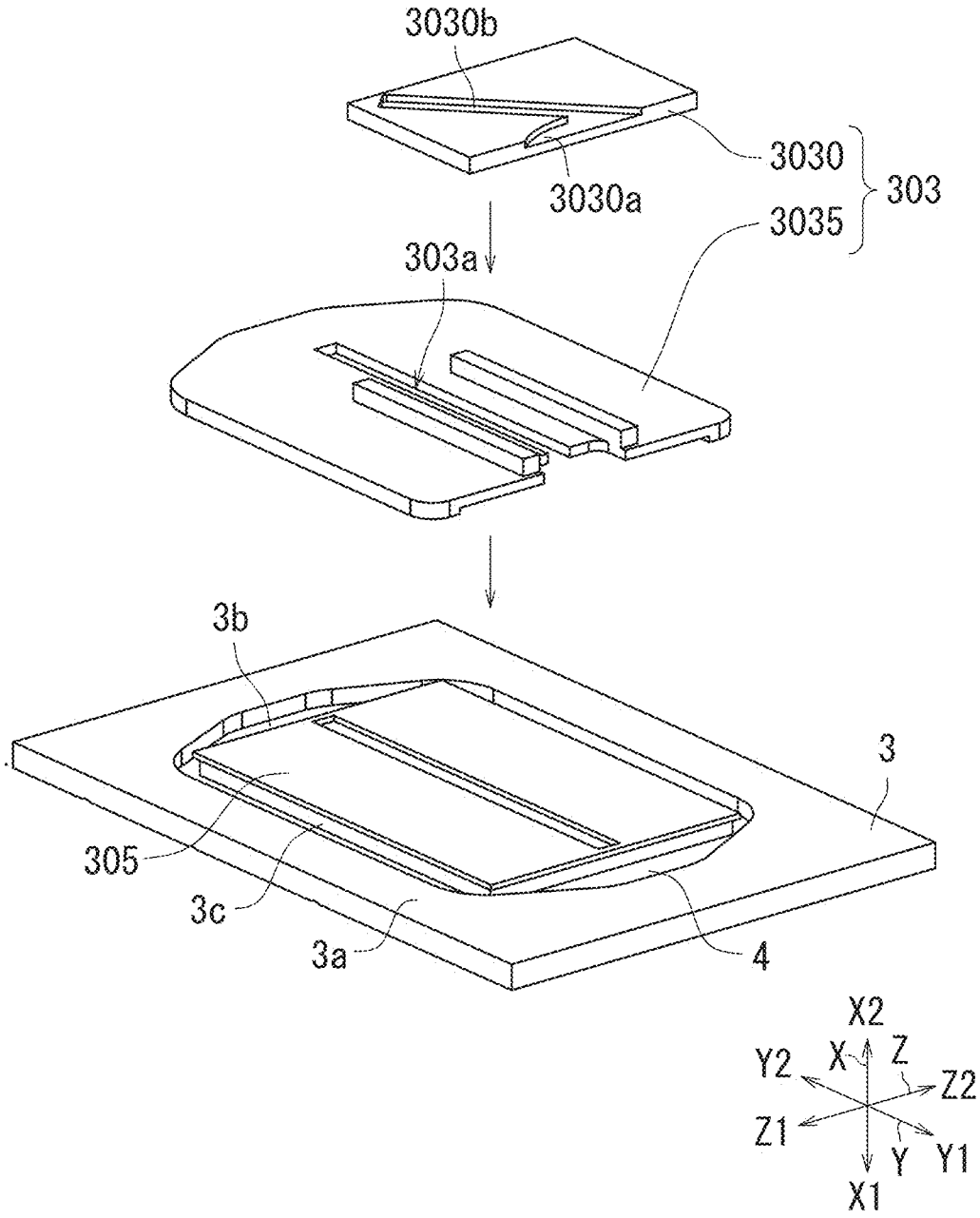
FIG. 6 is an exploded perspective view showing a structure of the cold plate and the partition of the pump device according to the first example embodiment.

Next, the structures of the second flow path 350, the heat exchange chamber 4, the first pump chamber 310, the first flow path 330, the second pump chamber 320, and the third outlet 342 will be described in detail with reference to FIGS. 3 to 6. FIG. 5 is an exploded perspective view showing the structure in which the first motor 110, the second motor 210, and the like are removed from the pump device 2 of the first exemplary example embodiment. FIG. 6 is an exploded perspective view showing the structure of the cold plate 3 and a partition 303 of the pump device 2 of the first example embodiment.

As shown in FIG. 4, the second flow path 350 stores the liquid flowing into the pump device 2 from the circulation route 6. In the present example embodiment, the second flow path 350 also functions as a tank. The second flow path 350 is disposed on the side of the first pump chamber 310, but is not disposed below the first pump chamber 310. The second flow path 350 is disposed on the side of the second pump chamber 320. In the present example embodiment, at least a part of the second flow path 350 is disposed on the one side X1 in the first direction X relative to the second pump chamber 320. Specifically, at least a part of the second flow path 350 is disposed on the one side X1 in the first direction X relative to the second bottom surface 321 of the second pump chamber 320. Therefore, by using a space between the second pump chamber 320 and the heat exchange chamber 4 as a flow path, it is possible to store a large amount of liquid.

Here, in the present example embodiment, the casing 300 has a casing main body 301 and the partition 303. The first pump 100 and the second pump 200 are disposed in the casing main body 301. The casing main body 301 constitutes, for example, the first pump chamber 310, the second pump chamber 320, the third inlet 341, and the third outlet 342. The partition 303 partitions the second flow path 350 and the heat exchange chamber 4. The second flow path 350 includes the casing main body 301 and the partition 303. In the present example embodiment, the second flow path 350 includes the casing main body 301 and a second partition 3035 described later of the partition 303.

As shown in FIGS. 4 to 6, the partition 303 is a substantially flat plate member. The partition 303 has the heat exchange chamber connection port 303*a* that connects the second flow path 350 and the heat exchange chamber 4. In the present example embodiment, the heat exchange chamber connection port 303*a* is formed in a slit shape. The heat exchange chamber connection port 303*a* extends in the second direction Y. The liquid in the second flow path 350 moves to the heat exchange chamber 4 via the heat exchange chamber connection port 303*a*.

In the present example embodiment, the partition 303 has a first partition 3030 and the second partition 3035. In the present example embodiment, the second partition 3035 has the heat exchange chamber connection port 303*a*. As shown in FIGS. 3 and 5, the heat exchange chamber connection port 303*a* and the first flow path 330 are disposed to overlap each other when viewed from the first direction X. In the present example embodiment, as described above, since the partition 303 has the first partition 3030 and the second partition 3035, the heat exchange chamber connection port 303*a* and the first flow path 330 can be overlapped when viewed from the first direction X. In other words, even when the heat exchange chamber connection port 303*a* and the first flow path 330 are disposed to overlap each other, the heat exchange chamber connection port 303*a* and the first flow path 330 are partitioned by the first partition 3030. Therefore, it is possible to suppress liquid from leaking between the heat exchange chamber connection port 303*a* and the first flow path 330. The structure of the first partition 3030 will be described later.

The heat exchange chamber 4 includes the cold plate 3 and the partition 303. In the present example embodiment, the heat exchange chamber 4 includes the cold plate 3 and the second partition 3035. The cold plate 3 is a plate-like member having a predetermined thickness. The cold plate 3 has a plate main body 3*a*, a storage recess part 3*b*, and a fin part 3*c*. The surface of the plate main body 3*a* on the one side X1 in the first direction X comes into contact with the heat generating component. The storage recess part 3*b* is provided on the surface of the plate main body 3*a* on the other side X2 in the first direction X. The storage recess part 3*b* stores liquid. The storage recess part 3*b* expands in the second direction Y and the third direction Z of the plate main body 3*a*. The fin part 3*c* is provided in the storage recess part 3*b*. The fin part 3*c* has a plurality of fins and is formed integrally with the plate main body 3*a*.

The heat transferred from the heat generating component to the plate main body 3*a* is transferred to the liquid passing through the inside of the storage recess part 3*b*. At this time, the contact area with the liquid is so large in the fin part 3*c* that heat is efficiently transferred to the liquid.

In the present example embodiment, an elastic sheet 305 is disposed between the fin part 3*c* and the second partition 3035. The elastic sheet 305 is, for example, a rubber sheet. The elastic sheet 305 comes into contact with the fin part 3*c*. This allows liquid from to be suppressed from staying in a gap between the fin part 3*c* and the second partition 3035, and the liquid flowing from the heat exchange chamber connection port 303*a* to efficiently flow between the plurality of fins. As a result, heat exchange efficiency is improved. Note that the elastic sheet 305 needs not to be provided.

The first pump chamber 310 is formed by the casing main body 301. In the present example embodiment, the first pump chamber 310 is formed by the casing main body 301 and the partition 303.

Figure 7:
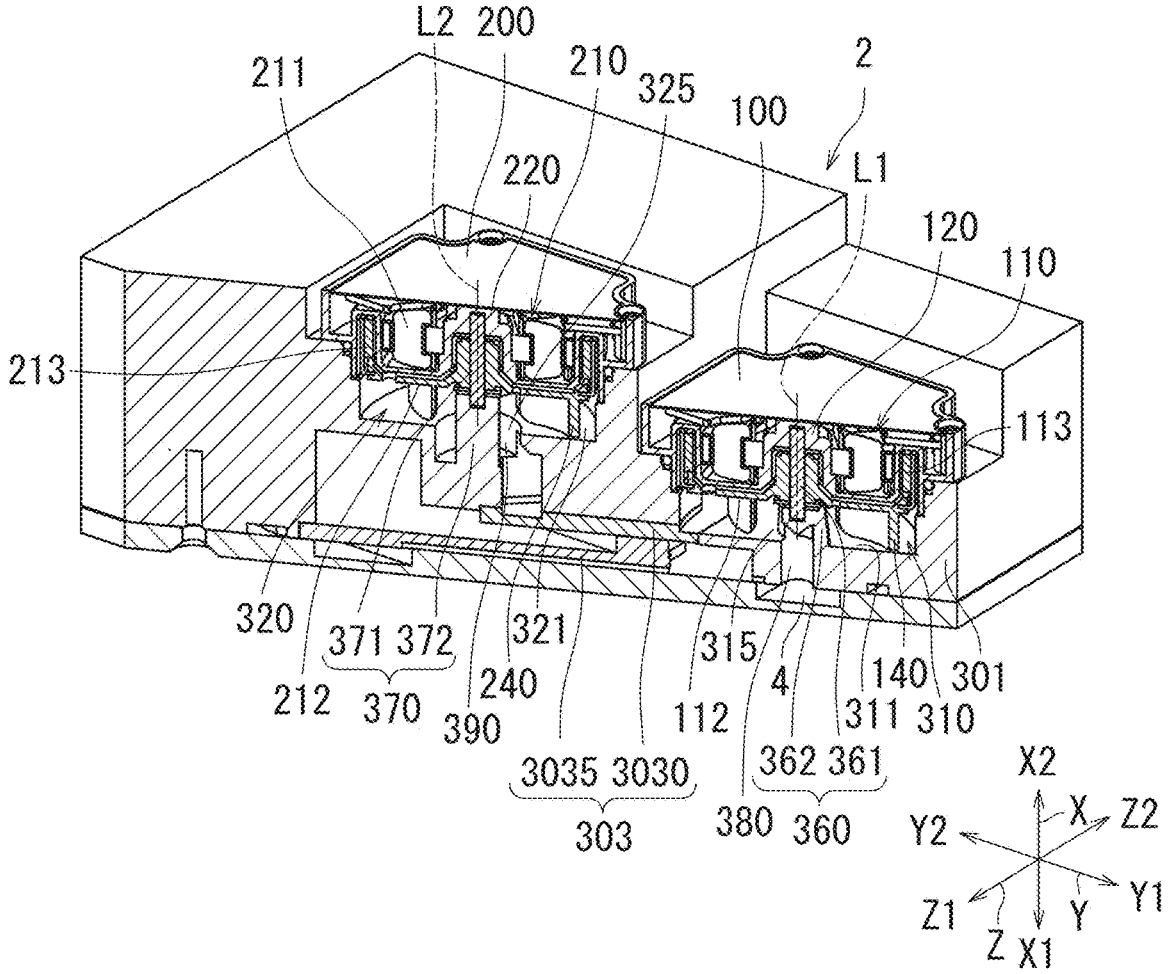
FIG. 7 is a cross-sectional perspective view of the pump device of the first example embodiment taken along with a cross section passing through the center of the first motor and the center of the second motor.

Here, a detailed structure of the first pump 100 will be described with reference to FIG. 7. FIG. 7 is a cross-sectional perspective view of the pump device 2 of the first example embodiment taken along with a cross section passing through the center of the first motor 110 and the center of the second motor 210. As shown in FIG. 7, the first pump 100 disposed in the first pump chamber 310 has a first holding member 120 and a first impeller 140 in addition to the first motor 110. The first holding member 120 holds the first motor 110.

Specifically, the first holding member 120 covers the other side X2 in the first direction X of the first pump chamber 310. The first motor 110 has a first stator 111, a first rotor 112, and a first magnet 113. The first stator 111 is disposed on the other side X2 in the first direction X with respect to the first holding member 120. Therefore, the first stator 111 is isolated from the liquid flowing in the first pump chamber 310 by the first holding member 120. The other side X2 in the first direction X of the first holding member 120 is filled with a resin (not illustrated), and the first stator 111 is inserted thereto. This improves the waterproof property of the first stator 111.

The first rotor 112 is disposed on the one side X1 in the first direction X with respect to the first holding member 120. The first magnet 113 is, for example, a permanent magnet. The first magnet 113 is fixed to the first rotor 112. The first magnet 113 is disposed outside in the radial direction of a first rotation axis L1 relative to the first stator 111. The first rotation axis L1 is a rotation center of the first rotor 112. The first rotation axis L1 extends in the first direction X. The first impeller 140 is fixed to the one side X1 in the first direction X of the first rotor 112. When the first rotor 112 rotates about the first rotation axis L1, the first impeller 140 also rotates about the first rotation axis L1. Then, the liquid in the first pump chamber 310 flows out from the first outlet 317.

The casing 300 has a first support shaft portion 360 that supports the first rotor 112. The first support shaft portion 360 is disposed at the center of the first bottom surface 311 of the first pump chamber 310. The first support shaft portion 360 is disposed on the first rotation axis L1. In the present example embodiment, the first support shaft portion 360 has a first rotation center shaft 361 and a first support part 362 that supports the first rotation center shaft 361. In the present example embodiment, the first rotation center shaft 361 is supported by the first support part 362 and the first holding member 120. The first rotor 112 rotates about the first rotation center shaft 361. In the present example embodiment, the first rotation center shaft 361 does not rotate, but the first rotation center shaft 361 may rotate together with the first rotor 112.

In the present example embodiment, the first support part 362 and the casing main body 301 are, for example, integrally molded. The first support part 362 and the casing main body 301 needs not to be integrally molded.

The casing 300 has a first connection flow path 380. The first connection flow path 380 extends in the first direction X. In the present example embodiment, the first connection flow path 380 is disposed inside the first support shaft portion 360 and on the one side X1 in the first direction X. The first connection flow path 380 is connected to the heat exchange chamber 4 and is connected to the first inlet 315 of the first pump chamber 310.

As shown in FIG. 3, the first flow path 330 includes the casing main body 301 and the first partition 3030. In other words, the casing main body 301 and the partition 303 constitute the first flow path 330. That is, since the casing main body 301 and the partition 303 are formed of separate members, the first flow path 330 can be formed by manufacturing the casing main body 301 and the partition 303 by resin molding. Even if an attempt is made to manufacture, by resin molding as an integrally molded product, the casing main body 301 and the partition 303 that constitute the first flow path 330, it is not possible to manufacture them by resin molding because the mold component forming the first flow path 330 does not come off.

As shown in FIGS. 5 and 6, the first partition 3030 is formed of a flat member. The first partition 3030 has a first recess part 3030*a* and a second recess part 3030*b*. The first recess part 3030*a* and the second recess part 3030*b* are provided on the other side X2 in the first direction X of the first partition 3030. The first recess part 3030*a* constitutes a part of the first pump chamber 310. The second recess part 3030*b* constitutes a part of the first flow path 330.

Figure 8:
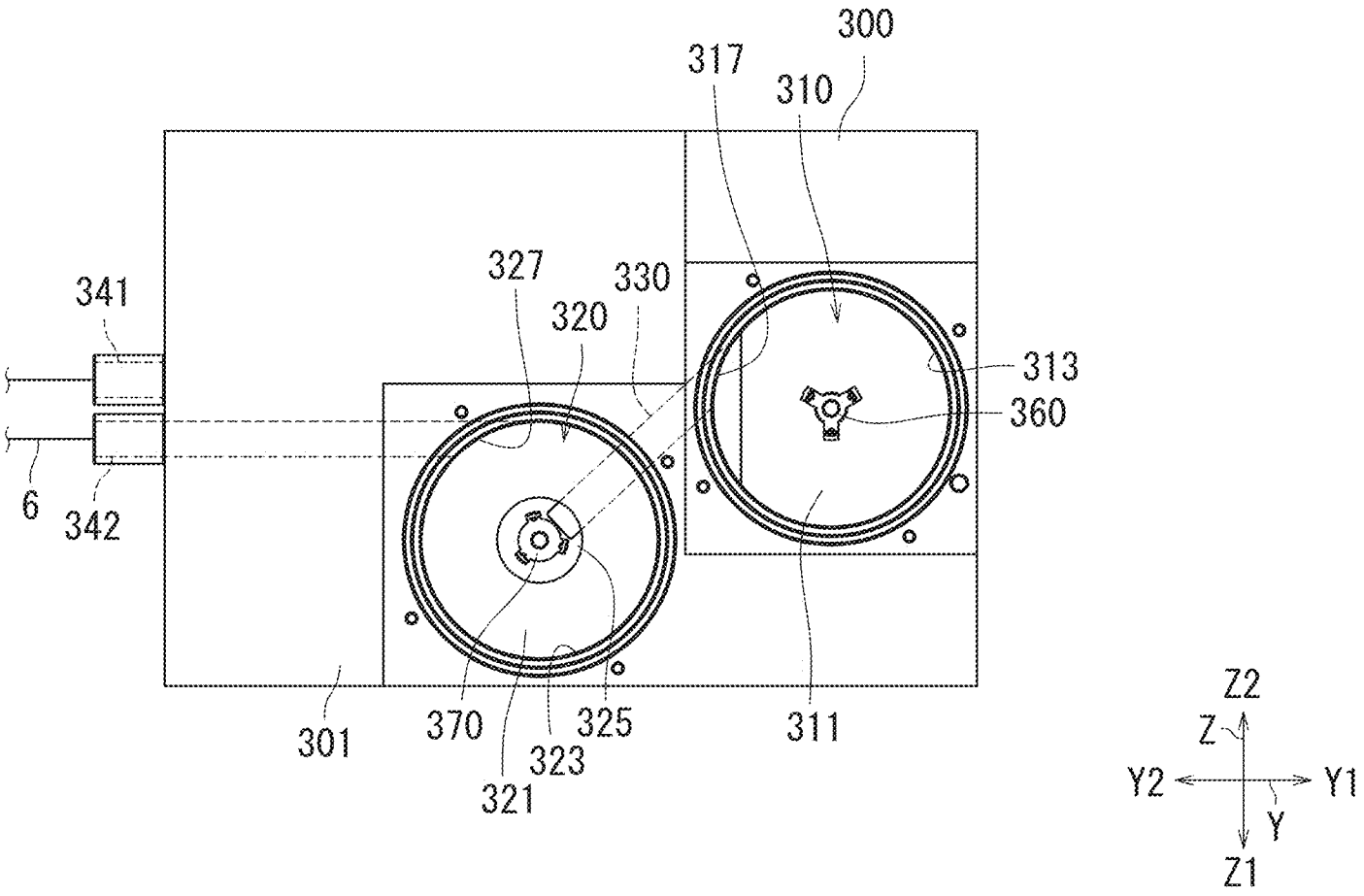
FIG. 8 is a plan view showing a structure in which the first motor, the second motor, and the like are removed from the pump device of the first example embodiment.

Here, the structure of the first flow path 330 will be further described with reference to FIG. 8. FIG. 8 is a plan view showing the structure in which the first motor 110, the second motor 210, and the like are removed from the pump device 2 of the first example embodiment. As shown in FIG. 8, the first flow path 330 extends tangentially from the first side surface 313 of the first pump chamber 310 and is connected to the second inlet 325. Therefore, the liquid flowing along the first side surface 313 can smoothly flow to the second inlet 325. In the present example embodiment, the first flow path 330 extends in a straight line when viewed from the first direction X.

As shown in FIG. 7, the second pump chamber 320 is formed by the casing main body 301. The second pump 200 disposed in the second pump chamber 320 has a second holding member 220 and a second impeller 240 in addition to the second motor 210. The second holding member 220 holds the second motor 210.

Specifically, the second holding member 220 covers the other side X2 in the first direction X of the second pump chamber 320. The second motor 210 has a second stator 211, a second rotor 212, and a second magnet 213. Note that the second stator 211 is an example of the "stator" of the present disclosure. The second rotor 212 is an example of the "rotor" of the present disclosure.

The second stator 211 is disposed on the other side X2 in the first direction X with respect to the second holding member 220. Therefore, the second stator 211 is isolated from the liquid flowing in the second pump chamber 320 by the second holding member 220. The other side X2 in the first direction X of the second holding member 220 is filled with a resin (not illustrated), and the second stator 211 is inserted thereto. This improves the waterproof property of the second stator 211.

The second rotor 212 is disposed on the one side X1 in the first direction X with respect to the second holding member 220. The second magnet 213 is, for example, a permanent magnet. The second magnet 213 is fixed to the second rotor 212. The second magnet 213 is disposed outside in the radial direction of a second rotation axis L2 relative to the second stator 211. The second rotation axis L2 is a rotation center of the second rotor 212. The second rotation axis L2 extends in the second direction Y. The second impeller 240 is fixed to the one side X1 in the first direction X of the second rotor 212. When the second rotor 212 rotates about the second rotation axis L2, the second impeller 240 also rotates about the second rotation axis L2. Then, the liquid in the second pump chamber 320 flows out from the second outlet 327.

The casing 300 has a second support shaft portion 370 that supports the second rotor 212. The second support shaft portion 370 is an example of the "support shaft portion" of the present disclosure. The second support shaft portion 370 is disposed at the center of the second bottom surface 321 of the second pump chamber 320. The second support shaft portion 370 is disposed on the second rotation axis L2. In the present example embodiment, the second support shaft portion 370 has a second rotation center shaft 371 and a second support part 372 that supports the second rotation center shaft 371. In the present example embodiment, the second rotation center shaft 371 is supported by the second support part 372 and the second holding member 220. The second rotor 212 rotates about the second rotation center shaft 371. In the present example embodiment, the second rotation center shaft 371 does not rotate, but the second rotation center shaft 371 may rotate together with the second rotor 212.

In the present example embodiment, the second support part 372 and the casing main body 301 are, for example, integrally molded. The second support part 372 and the casing main body 301 needs not to be integrally molded.

The casing 300 has a second connection flow path 390. The second connection flow path 390 is an example of the "connection flow path" of the present disclosure. The second connection flow path 390 extends in the first direction X along the second support shaft portion 370. The second connection flow path 390 is connected to the first flow path 330 and is connected to the second inlet 325 of the second pump chamber 320. Therefore, the liquid flowing from the first pump 100 in a direction substantially orthogonal to the second rotation axis L2 can smoothly flow in a direction along the second rotation axis L2.

As shown in FIG. 8, the third outlet 342 extends tangentially from the second side surface 323 of the second pump chamber 320 and is connected to the circulation route 6.

Figure 9:
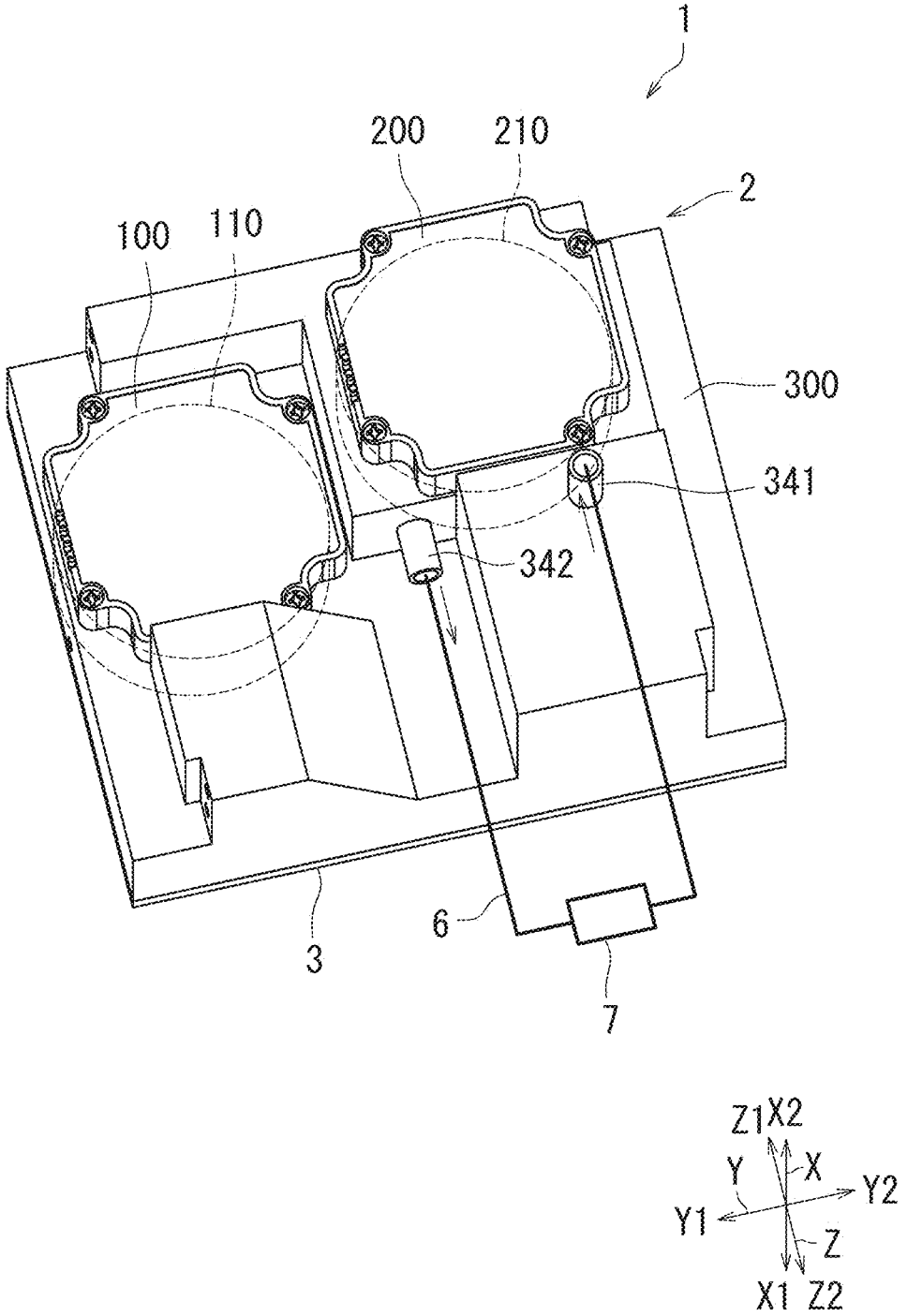
FIG. 9 is a perspective view showing a cooling device including a pump device according to a second example embodiment of the present disclosure and a circulation route connected to the cooling device.
Figure 10:
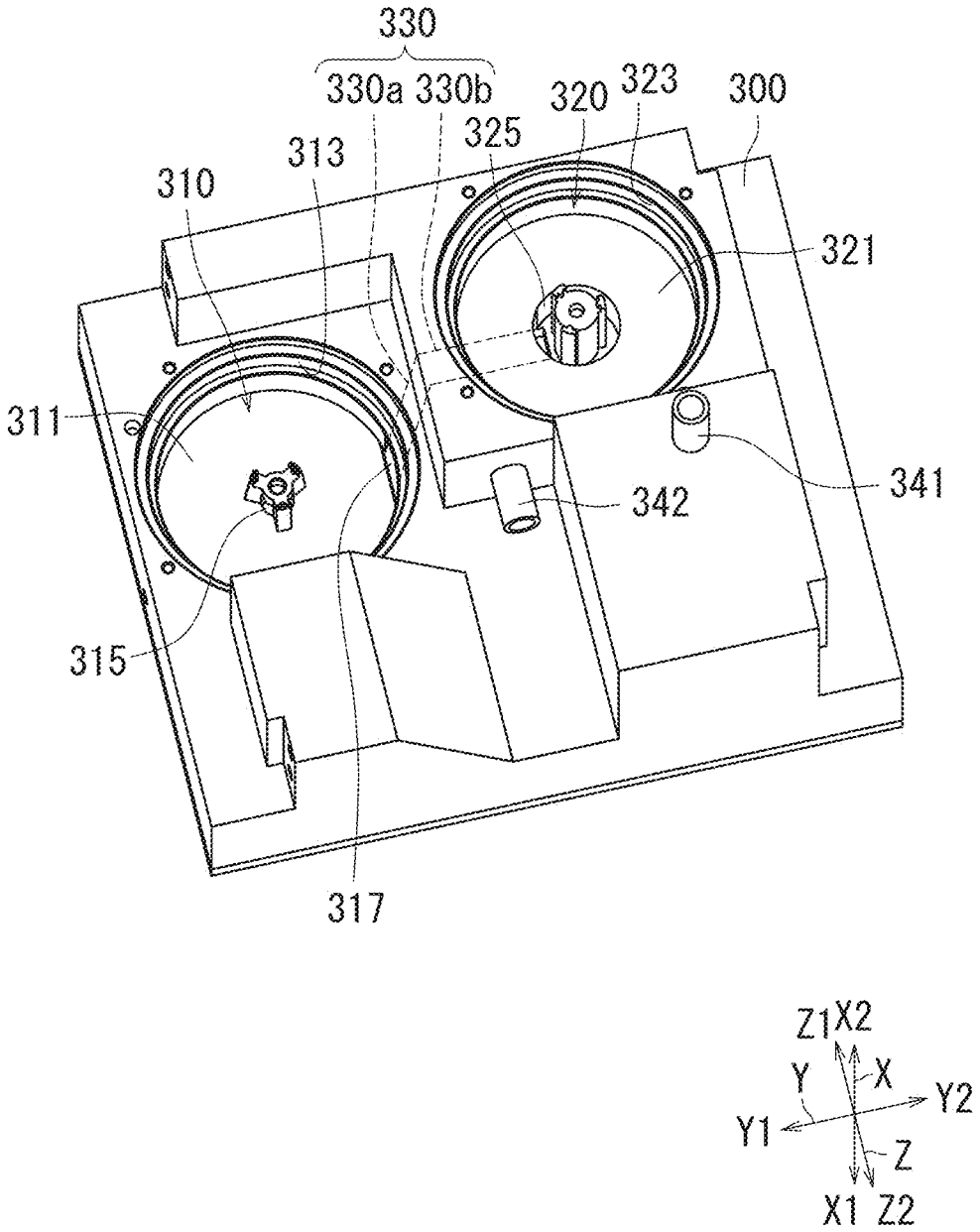
FIG. 10 is a perspective view showing a structure in which a first motor, a second motor, and the like are removed from the pump device of the second example embodiment.
Figure 11:
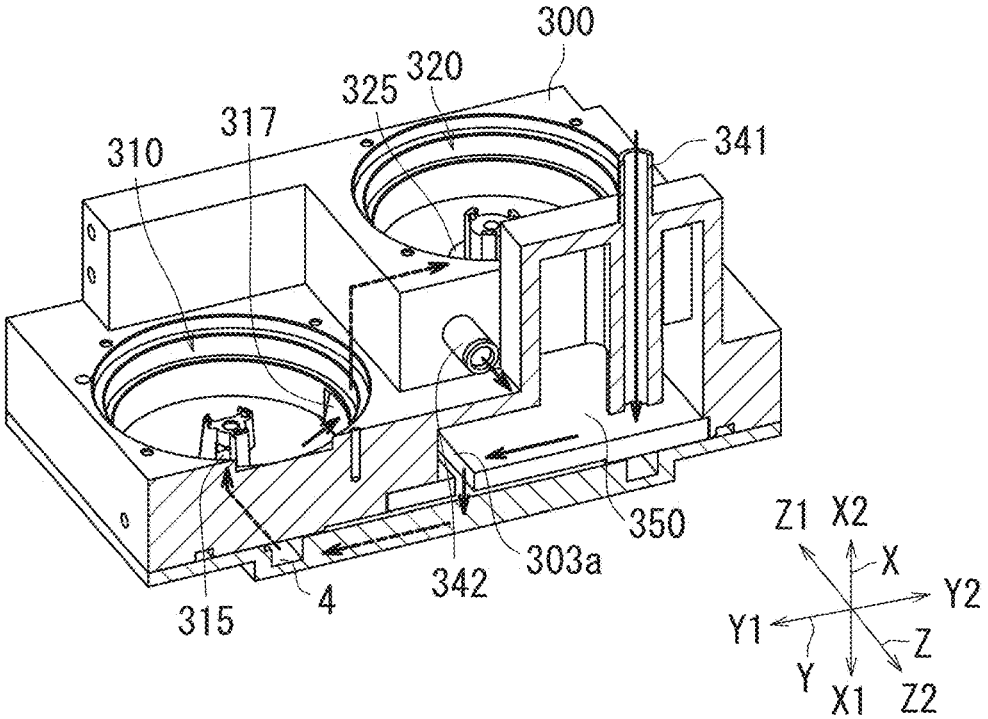
FIG. 11 is a cross-sectional perspective view showing a structure in which the first motor, the second motor, and the like are removed from the pump device of the second example embodiment.
Figure 12:
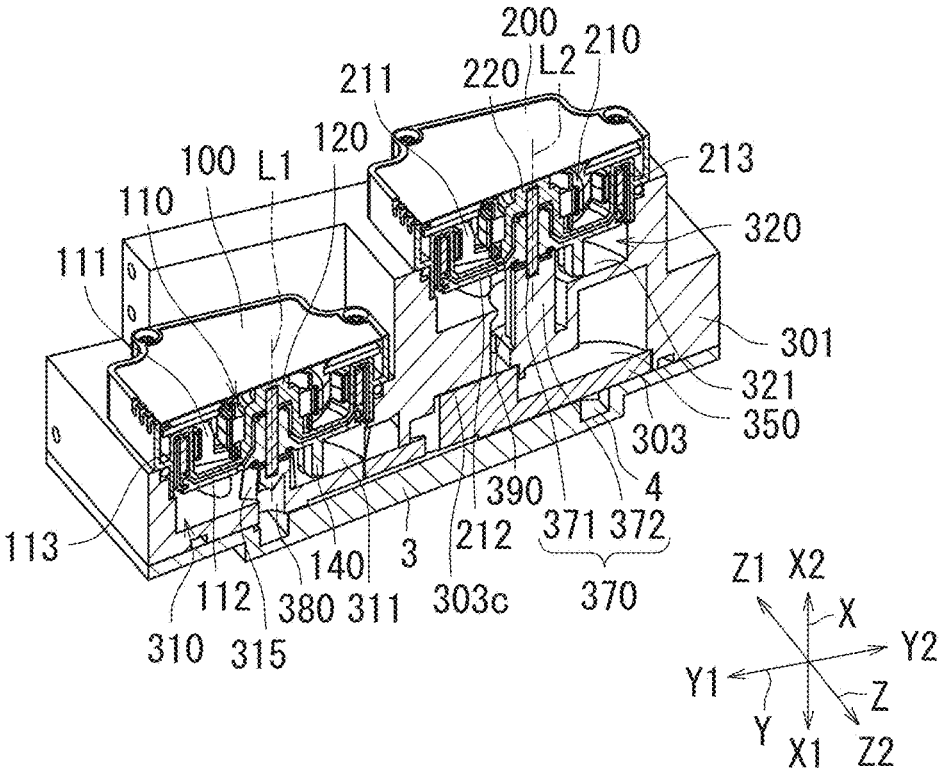
FIG. 12 is a cross-sectional perspective view of the pump device of the second example embodiment taken along with a cross section passing through the center of the first motor and the center of the second motor.

A cooling device 1 including a pump device 2 according to the second example embodiment of the present disclosure will be described with reference to FIGS. 9 to 15. FIG. 9 is a perspective view showing the cooling device 1 including the pump device 2 according to the second example embodiment of the present disclosure and the circulation route 6 connected to the cooling device 1. FIG. 10 is a perspective view showing the structure in which a first motor 110, a second motor 210, and the like are removed from the pump device 2 of the second example embodiment. FIG. 11 is a cross-sectional perspective view showing the structure in which the first motor 110, the second motor 210, and the like are removed from the pump device 2 of the second example embodiment. FIG. 12 is a cross-sectional perspective view of the pump device 2 of the second example embodiment taken along with a cross section passing through the center of the first motor 110 and the center of the second motor 210. In the second example embodiment, unlike the first example embodiment, an example in which the partition 303 includes one member will be described. In the present example embodiment, unlike the first example embodiment, a description will be given with reference to the drawings in which the first pump 100 is disposed on the left side and the second pump 200 is disposed on the right side.

As shown in FIG. 9, similarly to the first example embodiment, the cooling device 1 has the pump device 2, the cold plate 3, and the heat exchange chamber 4 (see FIG. 11).

As shown in FIG. 10, similarly to the first example embodiment, the casing 300 has the first pump chamber 310 and the second pump chamber 320. The first pump chamber 310 and the second pump chamber 320 are connected by the first flow path 330.

In the present example embodiment, unlike the first example embodiment, the first flow path 330 is not formed linearly in plan view. Specifically, the first flow path 330 is bent in plan view. The first flow path 330 has a linear part 330*a* extending tangentially from the first side surface 313 and a part 330*b* extending parallel to the second direction Y.

In the present example embodiment, the third inlet 341 and the third outlet 342 are disposed in the upper part of the casing 300. The third inlet 341 extends in the first direction X. The third outlet 342 extends in the third direction Z.

As shown in FIG. 11, in the present example embodiment, similarly to the first example embodiment, the liquid passes through in order of the third inlet 341, the second flow path 350, the heat exchange chamber connection port 303*a*, the heat exchange chamber 4, the first inlet 315, the first pump chamber 310, the first outlet 317, the first flow path 330 (see FIG. 10), the second inlet 325, the second pump chamber 320, the second outlet 327, and the third outlet 342.

In the present example embodiment, the third inlet 341 extends to the lower part in the second flow path 350. As shown in FIG. 12, similarly to the first example embodiment, at least a part of the second flow path 350 is disposed on the one side X1 in the first direction X relative to the second bottom surface 321 of the second pump chamber 320.

In the present example embodiment, as shown in FIG. 11, at least a part of the second flow path 350 is disposed on the other side X2 in the first direction X relative to the second pump chamber 320. Therefore, even when air flows into the second flow path 350 from the third inlet 341, the air can stay in the second flow path 350. As a result, it is possible to suppress the air from flowing to the first pump 100 and the second pump 200.

Figure 13:
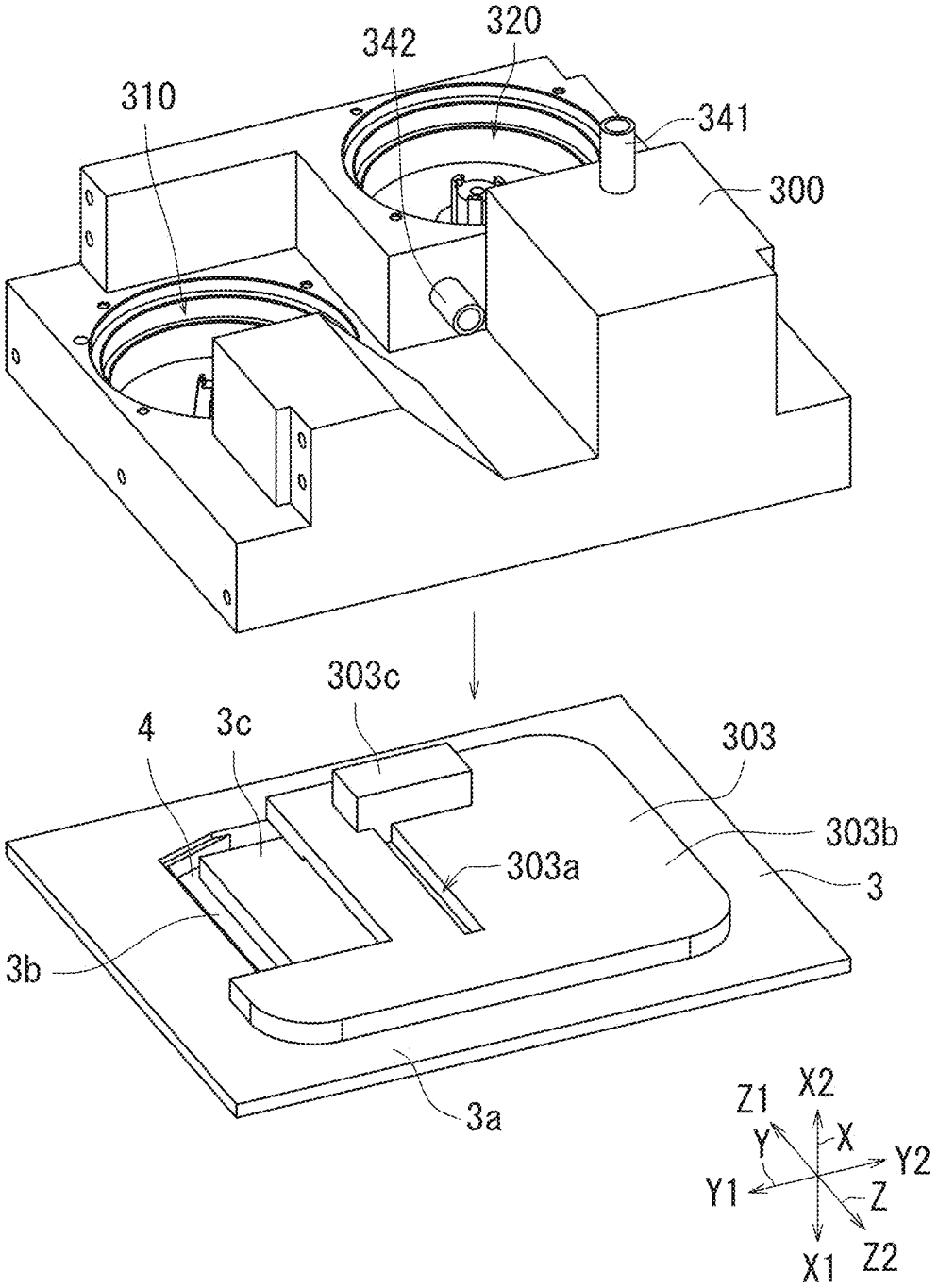
FIG. 13 is an exploded perspective view showing a structure in which the first motor, the second motor, and the like are removed from the pump device of the second example embodiment.
Figure 14:
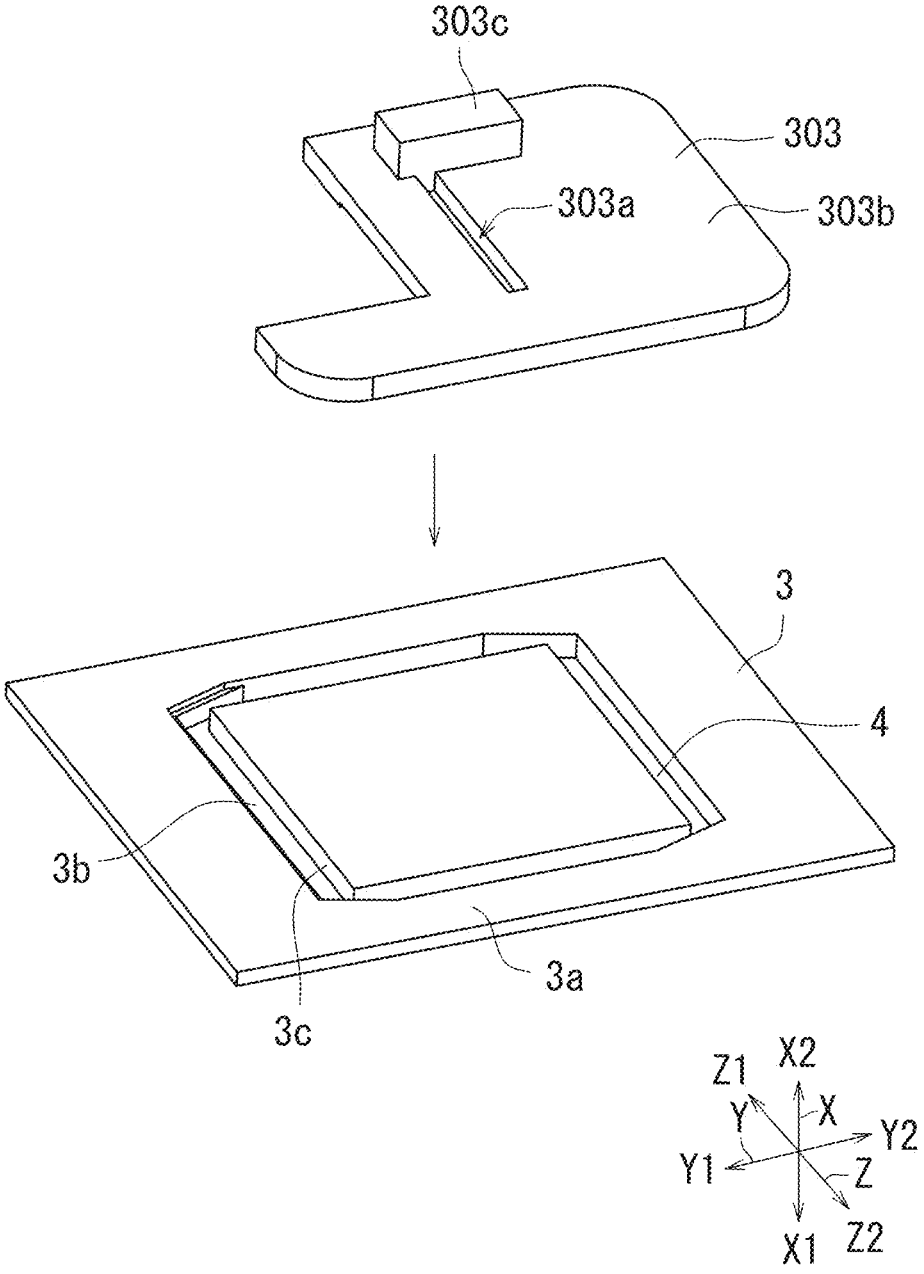
FIG. 14 is an exploded perspective view showing a structure of the cold plate and the partition of the pump device according to the second example embodiment.
Figure 15:
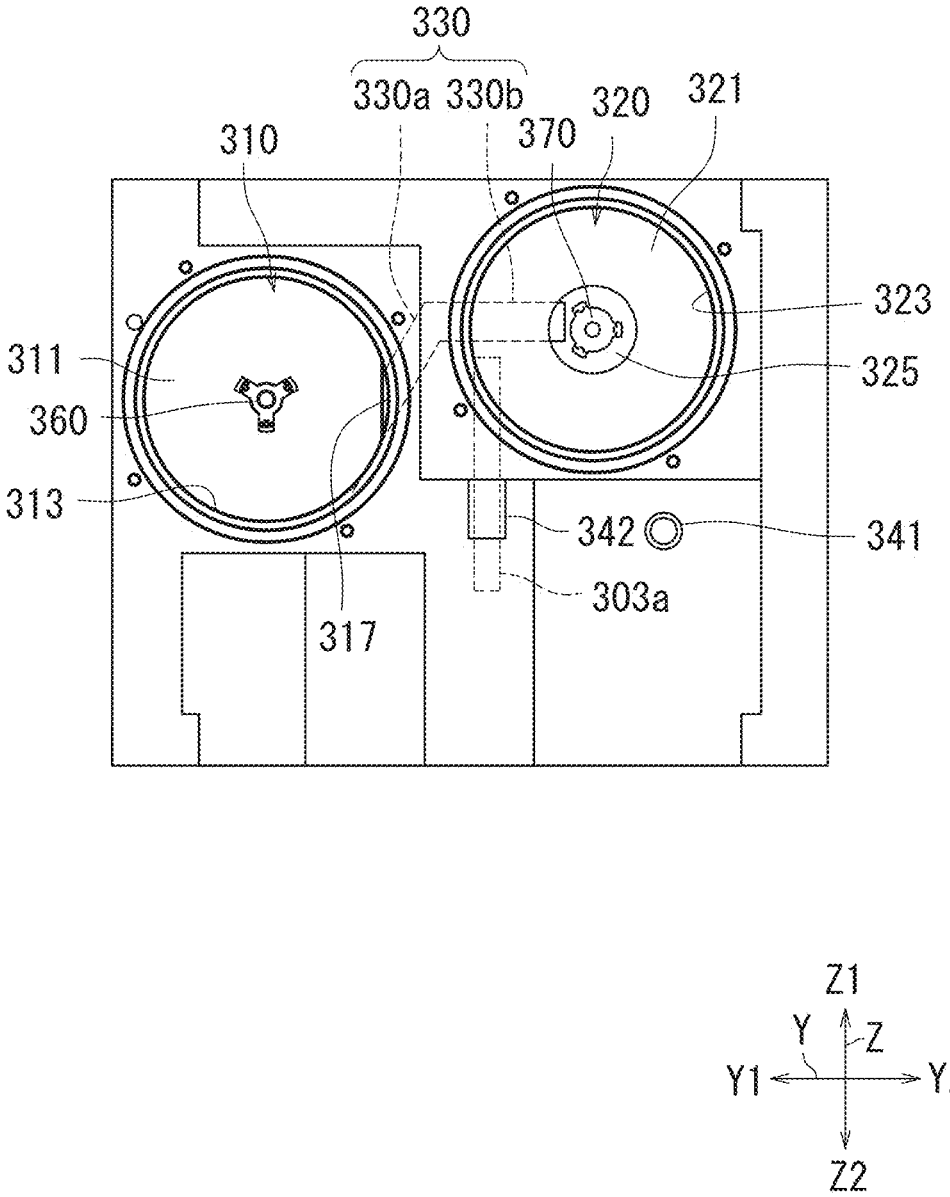
FIG. 15 is a plan view showing a structure in which the first motor, the second motor, and the like are removed from the pump device of the second example embodiment.

Next, the structure around the partition 303 will be described with reference to FIGS. 13 to 15. FIG. 13 is an exploded perspective view showing the structure in which the first motor 110, the second motor 210, and the like are removed from the pump device 2 of the second example embodiment. FIG. 14 is an exploded perspective view showing the structure of the cold plate 3 and a partition 303 of the pump device 2 of the second example embodiment. FIG. 15 is a plan view showing the structure in which the first motor 110, the second motor 210, and the like are removed from the pump device 2 of the second example embodiment.

As shown in FIGS. 13 and 14, in the present example embodiment, the partition 303 includes one member. That is, the partition 303 does not have the first partition 3030 and the second partition 3035. The partition 303 has the heat exchange chamber connection port 303*a*, a flat plate part 303*b*, and a protrusion part 303*c*. The heat exchange chamber connection port 303*a* is disposed on the flat plate part 303*b*. The heat exchange chamber connection port 303*a* extends in the third direction Z. The protrusion part 303*c* constitutes the bottom surface of the part 330*b* (see FIG. 10) of the first flow path 330. The width in the third direction Z of the protrusion part 303*c* is larger than the width in the third direction Z of the part 330*b* of the first flow path 330.

In the present example embodiment, the casing main body 301 and the partition 303 constitute the first flow path 330 and the second flow path 350 (see FIG. 12). The partition 303 partitions the first flow path 330 and the heat exchange chamber 4.

As shown in FIG. 15, in the present example embodiment, the first flow path 330 and the heat exchange chamber connection port 303*a* are separated from each other when viewed from the first direction X. Therefore, as shown in FIG. 12, the casing main body 301 and one member (partition 303) can constitute the first flow path 330 and the second flow path 350. The one member (partition 303) can partition the first flow path 330 and the heat exchange chamber 4.

Other structures and effects of the present example embodiment are similar to those of the first example embodiment.

The example embodiments (including modifications) of the present disclosure have been described above with reference to the drawings. However, the present disclosure is not limited to the above example embodiments, and can be implemented in various modes without departing from the gist thereof. Various disclosures can be formed by appropriately combining a plurality of constituent elements having been invented in the above example embodiments. For example, some constituent elements may be removed from all the constituent elements described in the example embodiments. For example, constituent elements across different example embodiments may be combined as appropriate. The constituent elements in the drawings are mainly and schematically shown to facilitate better understanding, and the thickness, length, number, interval, and the like of each constituent element shown in the drawings may differ from actual ones for the convenience of creating the drawings. The material, shape, dimension, and the like of each constituent element shown in the above example embodiments are merely examples and not to be specifically limited, and various modifications can be made without substantially departing from the effects of the present disclosure.

For example, in the first example embodiment and the second example embodiment described above, an example in which the pump device 2 is used for the cooling device 1 has been described, but the present disclosure is not limited thereto, and the pump device 2 may be used for a device other than the cooling device 1.

The present disclosure can be used for a pump device and a cooling device, for example.

Features of the above-described example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A cooling device comprising:

a first pump;

a second pump;

a casing in which the first pump and the second pump are located;

a cold plate; and a heat exchange chamber; wherein the first pump and the second pump are centrifugal pumps;

the first pump includes a first motor;

the second pump includes a second motor;

the casing includes a casing main body, a partition, a first pump chamber in which the first pump is located, and a second pump chamber in which the second pump is located;

the first pump and the second pump are in the casing main body;

the first pump chamber includes a first bottom surface that is located on one side in a first direction with respect to the first motor, a first side surface that is connected to the first bottom surface and extends in the first direction, a first inlet that is open with respect to the first bottom surface, and a first outlet that is open with respect to the first side surface;

the second pump chamber includes a second bottom surface that is located on one side in the first direction with respect to the second motor, a second side surface that is connected to the second bottom surface and extends in the first direction, a second inlet that is open with respect to the second bottom surface, and a second outlet that is open with respect to the second side surface;

the second bottom surface is located at a different position in the first direction relative to the first bottom surface such that the first bottom surface and the second bottom surface do not overlap one another when viewed along a second direction which is perpendicular to the first direction;

the casing further includes a first flow path that connects the first outlet and the second inlet, and a second flow path;

the partition includes a first partition and a second partition;

the first partition and the casing main body define the first flow path;

the second partition and the casing main body define the second flow path;

the second partition and the cold plate define the heat exchange chamber;

the second partition includes a heat exchange chamber connection port that connects the second flow path and the heat exchange chamber;

the first flow path and the heat exchange chamber connection port overlap each other when viewed from the first direction;

the casing includes a third inlet and a third outlet;

at least a portion of the second flow path is on another side in the first direction relative to the second dump chamber; and a liquid passes through in an order of the third inlet, the second flow path, the heat exchange chamber connection port, the heat exchange chamber, the first inlet, the first pump chamber, the first outlet, the first flow path, the second inlet, the second pump chamber, the second outlet, and the third outlet.

2. The cooling device according to claim 1, wherein the first flow path extends tangentially from the first side surface and is connected to the second inlet.

3. The cooling device according to claim 2, wherein the second motor includes a stator and a rotor;

the casing includes a support shaft portion that supports the rotor and a connection flow path that extends in the first direction along the support shaft portion; and the connection flow path is connected to the first flow path and connected to the second inlet of the second pump chamber.

4. The cooling device according to claim 1, wherein at least a portion of the second flow path is on one side in the first direction relative to the second bottom surface of the second pump chamber.

5. The cooling device according to claim 1, wherein the first direction is a vertical direction and the second direction is a horizontal direction.

6. A cooling device comprising:

a first pump;

a second pump;

a casing in which the first pump and the second pump are disposed;

a cold plate; and a heat exchange chamber; wherein the first pump and the second pump are centrifugal pumps;

the first pump includes a first motor;

the second pump includes a second motor;

the casing includes a first pump chamber in which the first pump is located and a second pump chamber in which the second pump is located;

the first pump chamber includes a first bottom surface that is located on one side in a first direction with respect to the first motor, a first side surface that is connected to the first bottom surface and extends in the first direction, a first inlet that is opening with respect to the first bottom surface, and a first outlet that is opening with respect to the first side surface;

the second pump chamber includes a second bottom surface that is located on one side in the first direction with respect to the second motor, a second side surface that is connected to the second bottom surface and extends in the first direction, a second inlet that is opening with respect to the second bottom surface, and a second outlet that is opening with respect to the second side surface;

the casing further includes a first flow path that connects the first outlet and the second inlet, and a second flow path; the second bottom surface is located at a different position in the first direction relative to the first bottom surface such that the first bottom surface and the second bottom surface do not overlap one another when viewed along a second direction which is perpendicular to the first direction;

a partition and a casing main body define the first flow path and the second flow path;

the partition includes a heat exchange chamber connection port that connects the second flow path and the heat exchange chamber;

the first flow path and the heat exchange chamber connection port are separated from each other when viewed from the first direction;

the partition partitions the first flow path and the heat exchange chamber;

the casing includes a third inlet and a third outlet;

at least a portion of the second flow path is on another side in the first direction relative to the second pump chamber; and a liquid passes through in an order of the third inlet, the second flow path, the heat exchange chamber connection port, the heat exchange chamber, the first inlet, the first pump chamber, the first outlet, the first flow path, the second inlet, the second pump chamber, the second outlet, and the third outlet.

7. The cooling device according to claim 6, wherein the first flow path extends tangentially from the first side surface and is connected to the second inlet.

8. The cooling device according to claim 7, wherein the second motor includes a stator and a rotor;

the casing includes a support shaft portion that supports the rotor and a connection flow path that extends in the first direction along the support shaft portion; and the connection flow path is connected to the first flow path and connected to the second outlet of the second pump chamber.

9. The cooling device according to claim 8, wherein at least a portion of the second flow path is on one side in the first direction relative to the second bottom surface of the second pump chamber.

10. The cooling device according to claim 6, wherein the first direction is a vertical direction and the second direction is a horizontal direction.

* * * * *